United States Patent [19]

Spilles

[11] 4,238,201

[45] Dec. 9, 1980

[54] GRILL CHARCOAL LIGHTER

[75] Inventor: Theodor Spilles, Essen, Fed. Rep. of Germany

[73] Assignee: Twente Convenience Products b.v., Enschede, Netherlands

[21] Appl. No.: 64,272

[22] Filed: Aug. 6, 1979

[30] Foreign Application Priority Data

Aug. 12, 1978 [DE] Fed. Rep. of Germany ..... 2835427

[51] Int. Cl.[3] ..... C10L 1/18

[52] U.S. Cl. ..... 44/51; 44/7 D; 252/309

[58] Field of Search ..... 44/7 D, 51, 76; 252/309

[56] References Cited

U.S. PATENT DOCUMENTS

| | | | |
|---|---|---|---|
| 3,183,068 | 5/1965 | Monick | 44/7 B |
| 4,084,939 | 4/1978 | Zmoda | 44/7 D |

FOREIGN PATENT DOCUMENTS

| | | | |
|---|---|---|---|
| 1444335 | 7/1976 | United Kingdom | 44/7 D |

*Primary Examiner*—Winston A. Douglas
*Assistant Examiner*—J. V. Howard
*Attorney, Agent, or Firm*—Martin A. Farber

[57] ABSTRACT

A grill charcoal lighter having a pasty emulsion of an alcohol in an amount from about 65 to 94% by weight, of about 0.5 to 2% aqueous solution of triethanolamine salt of alkylbenzene sulphonic acid (alkyl benzene sulphonate) as an emulsifier in an amount of about 4 to 13% by weight and of fine powdery or pulverulent silicon tetrachloride as filler in an amount of about 2 to 22% by weight.

7 Claims, No Drawings

GRILL CHARCOAL LIGHTER

The invention relates to a grill charcoal lighter, that is to say an igniter or primer for grills for the lighting of charcoal.

Grilling over an open charcoal fire has become so popular and has become so widespread that charcoal for grills is sold in shops or businesses of the most varied kind, for example in the trading of food or in food stores, in shops for camping articles, in markets and supermarkets etc. The igniters offered for this purpose for lighting the charcoal, however, do not meet the given requirements in a number of respects.

In accordance with the old conventional method of lighting charcoal by means of spirit, spirit is offered in bottles or canisters. The grills customary in domestic use, for camping, etc., as a rule do not have a grate on which the charcoal rests or a tray or pan or trough disposed under the grate into which spirit can be introduced and ignited under the charcoal. The spirit is therefore poured over the charcoal and ignited, in which procedure it frequently only burns off on the surface of the charcoal without igniting the charcoal. If the lighting operation is then repeated in the above-mentioned manner, because it is assumed that the charcoal has not been ignited or because upon replenishing with charcoal no glow in the ashes is suspected, a tall shooting-up of flames and even explosions may occur which can lead to serious injury and fires. It is known that when spirit is used, the biggest accidents may occur with heavy material damage and in some cases with fatal result.

Spirit or alcohol which is mixed with an oil to reduce the evaporation or vaporization and which is filled into plastic or synthetic material bottles that have a spray head or into aerosol cans is also offered as a grill charcoal lighter. For the above-mentioned reasons, this igniter has the same disadvantage that the charcoal is not ignited with sufficient certainty or security, and the risk of accidents through shooting flames or explosions is likewise very great. Beyond this, with the use of oils, are associated the disadvantages described below resulting from unburnt hydrocarbons.

Furthermore, grill characoal lighters are known which consist of wood dust, sawdust or similar fibrous materials which are soaked in paraffin and pressed into sheets, strips or cubes. The burning capacity and igniting capacity of these igniters is relatively low. Unpleasant smells result from emerging and evaporating paraffin. Above all, however, these igniters, like a badly burning candle, can burn with a smokey and sooty flame so that unburnt hydrocarbons or other poisonous gases may arise, which are harmful to health and come into contact with the food lying on the grill.

For lighting pit or bituminous coal, briquettes, wood, etc., in ovens, fireplaces, and the like, coal lighters are known in the form of solid, lumpy cubes, for the production of which an emulsion is produced from hydrocarbons, gernally petroleum, with an emulsifier, which emulsion is processed to form a solid substance by the addition of a resin and a binding or hardening agent for the resin. The use of these igniters as grill charcoal lighters likewise has the disadvantage that because of the hydrocarbon content and the other components a severe development of soot occurs when burning, which entrains substances which are harmful to health or poisonous and which penetrate into the food during the grilling.

Furthermore, a grill charcoal lighter is known which consists of a pasty emulsion containing alcohol, the emulsion being packed in metal tubes, and which emulsion decomposes in a relatively short time so that this igniter does not have adequate storage capacity. Consequently there is the risk that the user, intending to press paste out of the tube, presses on the tube, in which case first a solid mass can only be pressed through the tube opening with difficulty and subsequently or equally at the beginning a jet of liquid alcohol shoots out of the tube, which can lead to the same serious accidents as the use of spirit or alcohol as an igniter, described above.

The object of the invention is to avoid the above-mentioned disadvantages of the known igniters and to provide a grill charcoal lighter which can be stored without smell, has an unlimited storage capacity, can be handled simply and without risk and eliminates the risks of accidents, has an optimum burning and igniting capacity and brings about the ignition of the charcoal with safety or certainty, burns without smoke or smell, and can be used in closed rooms as well as in the open and in particular when burning, does not develop any poisonous gases or substances which are harmful to health, but has a cleanliness suited to food while burning.

According to the invention, this problem is solved by the grill charcoal lighter characterized in claim 1 in the form of a pasty emulsion which is based on the following findings and carried out experiments.

A grill charcoal lighter which is to meet the requirements mentioned in posing the above-mentioned problem must be produced from corresondingly pure, suitable products. The ideal fuel for such an igniter is alcohol which burns without smoke or smell and in so doing develops a great ignition capacity. Therefore for the production of the grill charcoal lighter according to the invention, any alcohol can be used which does not have any inadmissible components, impurities or admixtures, that is to say which has such a purity that no poisonous substances or substances harmful to health of the kind described above result during the burning.

In order to eliminate the disadvantages and risks associated with the use of liquid alcohol described above, in the grill charcoal lighter according to the invention, the alcohol is used in a pasty emulsion which binds and encloses the alcohol in a pore-like or porous manner so that during the ignition and burning of the grill charcoal lighter, the alcohol is always only released from the paste for burning at the exposed surface of the paste. In this manner, assurance is provided that a flaring up or an explosion of the entire quantity of alcohol cannot occur. The requirements for the additives for the production of such a paste, respectively, emulsion, should be therefore on the one hand that they impart the above-mentioned properties to the paste and on the other hand the same above-mentioned requirements for the additives regarding the purity should be made as for the alcohol used as fuel. In the search for such additives, research was therefore carried out in the fields of the food industry and the hygiene industry for suitable substances, with which experiments were carried out.

In so doing, in the field of the cosmetic industry, an emulsifier was found which is used in the production of lipsticks, namely triethanolamine salt of alkylbenzene sulphonic acid, an alkylbenzene sulphonate which for example is also an ordinary commercial neutral detergent raw material for the production of cosmetic detergents or washing agents, rinsing agents, etc. A known form used commercially is, for example, a liquid with a 50% content of active washing or surface-active substance (triethanolamine salt). Systematic experiments with aqueous solutions of triethanolamine salt as emulsifier have led to the recognition that satisfactory results can be achieved if about 4 to 13% by weight of emulsifier is used for the production of the emulsion and the content of triethanolamine salt in the aqueous solution is not below about 0.5% and does not exceed about 2%. When an emulsifier is used with a lower or higher content of triethanolamine salt, the stability of the emulsion is reduced and there is the risk, particularly with higher summer air temperatures, of a decomposition of the emulsion taking place which leads to a separation of alcohol and filler so that the required storage capacity is not achieved. Preferably a 0.8 to 1.2% aqueous solution of triethanolamine salt is used and experiments with this emulsifier in the production of the grill charcoal lighter according to the invention have shown that the required properties were achieved with excellent storage capacity and burning capacity of the igniter.

A suitable filler according to the above-mentioned requirements for building up the pasty grill charcoal lighter according to the invention was found in the form of fine powdery silicon tetrachloride which is used in the toothpaste industry for the production of tooth paste. Preferably a fine powdery or pulverulent silicon tetrachloride with a grain size below about 40 μm is used. The fine particles build up a three-dimensional framework in the liquid and the more pronounced this framework, the stronger is the gel formation. If the grain exceeds a size of about 0.04 mm, then the capacity of the filler to absorb the alcohol is reduced as is the capacity of the pasty emulsion to bind and enclose the alcohol in a pore-like manner such that the grill charcoal lighter always only burns at the exposed surface and that assurance is provided that a flaring up or an explosion of the whole amount of alcohol can certainly not occur.

Experiments have shown that in order to achieve satisfactory results which meet the given requirements, the prescription of the pasty emulsion may range approximately from 65 to 94% by weight of alcohol, 4 to 13% by weight of emulsifier and 2 to 22% by weight of filler. It was found that an optimum burning and igniting capacity by the use of as high a content of alcohol as possible is achieved when preferably about 92% by weight of alcohol, about 4.3% by weight of emulsifier and about 3.7% by weight of filler are used.

For the optimum achievement of the properties described above of the grill charcoal lighter according to the invention, the following method has been developed by experiments. The emulsifier is introduced by finely proportioned spraying into a portion of about half of the alcohol to be used. This liquid is placed in a homogenizing machine in which it is then enriched with the filler, which is added in portions, until a relatively thick, creamy mass results. This mass is then subsequently brought to the required pasty viscosity by adding the remaining portion of the alcohol. Instead of the above-mentioned, known homogenizing machine, agitators are customarly used for the production of emulsions, which cause coarse emulsions to form. Through the method of production described above and the use of a homogenizing machine, a microfine-mesh or meshed emulsion is produced for the grill charcoal lighter according to the invention, which guarantees that when the grill charcoal lighter burns, only the alcohol situated at the surface is released for burning in the manner described above and a flaring up or even the risk of explosion are avoided with absolute certainty. And furthermore a stability of the emulsion is achieved which renders possible a storage capacity in the closed state for years with certainty.

In order not only on the one hand to achieve this storage capacity in the closed state but also on the other hand to render possible for the user, in accordance with the above object, a use of the grill charcoal lighter that is as simple, clean and risk free as possible in a suitable, correctly porporioned amount, a suitable covering or casing for the pasty emulsion has been sought which, on the other hand meets the above requirements but on the other hand also prevents evaporation of alcohol and the development of smells by an alcohol-tight covering or casing of the paste, prevents self-ignition at an elevated temperature and meets the requirements outlined above with regard to the purity of the materials to avoid sustances harmful to health when burning. In a further development of the invention, therefore, the grill charcoal lighter is characterized by a welded-up foil bag containing the pasty emulsion in a measured amount and comprising an outer cellophane or cellulose glass foil which is coated internally with polyethylene. This covering is resistant to tearing, alcohol-tight and burns cleanly. A foil bag made of an outer cellophane or cellulose glass foil with a weight of about 35 g/m$^2$ has proved particularly advantageous, which foil is coated internally with polyethylene in a thickness of about 75 μm. If the coating is below the above-mentioned thickness of about 0.075 mm, then there is a risk that an absolutely reliable tightness or density of the foil bag is no longer assured. If a thicker or cellophane or cellulose glass foil is used and particularly with a greater thickness of the polyethylene coating, the foil bag becomes too greatly fire-inhibiting and its ash residues may settle sealingly on the pasty emulsion, and inhibit its burning. The convenient, absolutely safe and clean use of the grill charcoal lighter by the user is effected in such a manner that the foil bag is simply lit at the edge and placed on the grill. The flame spreads over the foil, dissolves the latter and exposes the paste, which then ignites at its surface and now charcoal can be laid on.

EMBODIMENT EXAMPLE

An ordinary commerical 99.9% isopropyl alcohol was used as fuel.

An ordinary commerical silicon tetracholoride with an average particle size of 7 to 40 μm was used as a filler. A specific surface of the fine powdery or pulverulent silicon tetrachloride of 380 to 50 m2/g corresponds to this grain size of 0.007 to 0.04 mm.

In order to produce the emulsifier, triethanolamine salt in the commercial form described above with a content of active washing substance of 50% was used. A 1% aqueous solution of triethanolamine salt was produced as emulsifier from 2% of this product with the addition of 98% water.

In order to produce the pastry emulsion, 91.5% by weight of alcohol, 5% by weight of the above-mentioned emulsifier and 3.5% by weight of filler were used.

The production of the pastry emulsion was effected in such a manner than the emulsifier, finely proportionned, was sprayed into an amount of 40% by weight of alcohol. The liquid thus obtained was introduced into a homogenizing machine in which a microfine-meshed emulsion was produced as a thick, creamy mass by the addition of the filler in portions. The rest of the alcohol, 51.5% by weight, was then added to this mass in the homogenizing machine.

The paste was packed or filled in proportioned amounts into foil bags, which were welded shut.

A thin cellophane or cellulose glass foil with a weight of 35 g/m$^2$ was used for the foil bags, which foil was coated on the inside of the foil bag with polyethylene 0.075 mm thick, as a result of which diffusion of the alcohol through the foil was prevented and a tight welding of the foil at the edge of the foil bags was achieved. When the grill charcoal lighter is lit, this foil disintegrates without forming poisonous gases and without lying on the paste as a crust, so that the ignition and burning of the paste are not hampered.

I claim:

1. A grill charcoal lighter comprising a pasty emulsion of an alcohol in an amount from about 65 to 94% by weight, of about 0.5 to 2% aqueous solution of triethanolamine salt of alkylbenzene sulphonic acid (alkyl benzene sulphonate) as an emulsifier in an amount of about 4 to 13% by weight, and of fine pulverulent silicon tetrachloride as a filler in an amount of about 2 to 22% by weight.

2. The grill charcoal lighter according to claim 1, wherein the emulsion has about b 0.8 to 1.2% aqueous solution of triethanolamine salt as the emulsifier.

3. The grill charcoal lighter according to claim 1 or 2, wherein the emulsion has silicon tetrachloride in a grain size below about 0.04 mm as the filler.

4. The grill charcoal lighter according to claim 1, wherein the emulsion has about 92% by weight of alcohol, about 4.3% by weight of the emulsifier and about 3.7% by weight of the filler.

5. The grill charcoal lighter according to claim 1, including a foil bag comprising an outer cellophane foil, said foil is coated internally with polyethylene, and said cellophane is welded closed and contains the pasty emulsion in a measured amount.

6. The grill charcoal lighter according to claim 5, wherein said foil bag comprises an outer cellophane foil with a weight of about 35 g/m$^2$, said foil is coated internally with polyethylene in a thickness of about 0.075 mm.

7. A method of producing the grill charcoal lighter according to claim 1, comprising the steps of introducing the emulsifier into a portion of the alcohol by a finely proportioned spraying-in, treating this liquid in a homogenizing machine, enriching the liquid with the filler by addition in portions to form a mass, adding the remaining amount of the alcohol to the mass.

* * * * *